US009347679B2

(12) United States Patent
Bruhnke et al.

(10) Patent No.: US 9,347,679 B2
(45) Date of Patent: May 24, 2016

(54) GRILLE DOOR OPENER

(71) Applicants: Lynne Bruhnke, Massapequa Park, NY (US); Daniel Roeper, Garden City, NY (US)

(72) Inventors: Lynne Bruhnke, Massapequa Park, NY (US); Daniel Roeper, Garden City, NY (US)

( * ) Notice: Subject to any disclaimer, the term of this patent is extended or adjusted under 35 U.S.C. 154(b) by 0 days.

(21) Appl. No.: 13/999,104

(22) Filed: Jan. 13, 2014

(65) Prior Publication Data

US 2015/0198352 A1 Jul. 16, 2015

(51) Int. Cl.

| | |
|---|---|
| ***E05B 3/00*** | (2006.01) |
| ***F24F 13/08*** | (2006.01) |
| ***F24F 13/10*** | (2006.01) |
| ***E05B 85/14*** | (2014.01) |
| ***E05B 5/00*** | (2006.01) |
| ***E05B 85/10*** | (2014.01) |
| *E05C 19/00* | (2006.01) |

(52) U.S. Cl.

CPC ..... *F24F 13/082* (2013.01); *E05B 5/00* (2013.01); *E05B 85/103* (2013.01); *E05B 85/14* (2013.01); *F24F 13/084* (2013.01); *F24F 13/10* (2013.01); *Y10S 292/31* (2013.01); *Y10T 292/57* (2015.04)

(58) Field of Classification Search

CPC ... Y10S 292/11; Y10S 292/31; Y10S 292/63; E05C 3/045; E05B 5/00; E05B 5/003; E05B 85/103; E05B 85/14; E05B 85/16; E05B 85/18; F24F 13/084; E06B 9/01; E06B 9/0623; E06B 2009/015

USPC ..... 292/1, 336.3, DIG. 11, DIG. 31, DIG. 63; 52/198, 660–676; 454/289, 290; 254/131, 132

See application file for complete search history.

(56) References Cited

U.S. PATENT DOCUMENTS

| | | | | | |
|---|---|---|---|---|---|
| 32,897 | A | * | 7/1861 | Sexton | 454/290 |
| 254,688 | A | * | 3/1882 | Parkinson | 126/167 |
| 588,133 | A | * | 8/1897 | Durfee | 292/1 |
| 791,381 | A | * | 5/1905 | Thompson | 210/532.1 |
| 892,080 | A | * | 6/1908 | Pishek | 292/336.3 |
| 943,298 | A | * | 12/1909 | Brown | 454/332 |
| 1,035,480 | A | * | 8/1912 | Schoudde | 210/247 |
| 1,336,210 | A | * | 4/1920 | Druliner | 454/332 |
| 1,455,464 | A | * | 5/1923 | Welker, Jr. | 254/131 |
| 1,726,867 | A | * | 9/1929 | Strang | 49/278 |
| 2,008,965 | A | * | 7/1935 | Miller | 454/208 |
| 2,010,680 | A | * | 8/1935 | Van Leuven | 254/131 |
| 2,140,935 | A | * | 12/1938 | Hart | 49/87.1 |
| 2,571,726 | A | * | 10/1951 | Koch | 454/310 |
| 2,575,499 | A | * | 11/1951 | Manow | 55/422 |
| 2,738,953 | A | * | 3/1956 | Feitig | 254/131 |
| 2,754,747 | A | * | 7/1956 | Bertling | 454/309 |
| 3,201,161 | A | * | 8/1965 | Castle | 292/173 |
| 3,341,971 | A | * | 9/1967 | Hartman, Jr. | 49/7 |
| 3,920,347 | A | * | 11/1975 | Sauriol et al. | 404/25 |
| 3,921,350 | A | * | 11/1975 | Van Schoyck | 52/180 |
| 4,244,768 | A | * | 1/1981 | Wiechowski et al. | 156/293 |
| 4,845,907 | A | * | 7/1989 | Meek | 52/177 |
| 4,864,078 | A | * | 9/1989 | Bowman | 174/486 |
| 5,123,776 | A | * | 6/1992 | Lang et al. | 404/25 |
| 5,172,520 | A | * | 12/1992 | Hostetler et al. | 49/449 |
| 5,465,462 | A | * | 11/1995 | Yamada | 16/438 |

(Continued)

FOREIGN PATENT DOCUMENTS

| | | | | | |
|---|---|---|---|---|---|
| FR | 2760721 | A1 | * | 9/1998 | B65D 25/28 |
| JP | 05139156 | A | * | 6/1993 | B60H 1/34 |
| WO | WO 2011088234 | A1 | * | 7/2011 | |

*Primary Examiner* — Carlos Lugo

(57) ABSTRACT

A door opener for a linear bar grille.

13 Claims, 5 Drawing Sheets

(56) References Cited

U.S. PATENT DOCUMENTS

| | | | | | |
|---|---|---|---|---|---|
| 5,586,837 | A * | 12/1996 | Udelle | 52/12 |
| 5,586,934 | A * | 12/1996 | Dombrowski et al. | 454/309 |
| 5,720,660 | A * | 2/1998 | Benedetto et al. | 454/284 |
| 5,864,990 | A * | 2/1999 | Tu | 52/19 |
| D428,999 | S * | 8/2000 | Glab et al. | D25/36 |
| 7,293,937 | B2 * | 11/2007 | Fuchs et al. | 404/2 |
| 7,303,669 | B2 * | 12/2007 | Monneret | 210/164 |
| 7,328,478 | B2 * | 2/2008 | Jenkins | 15/301 |
| 7,549,260 | B2 * | 6/2009 | Shepherd | 52/668 |
| 7,566,263 | B2 * | 7/2009 | Snyder | 454/332 |
| 7,581,655 | B1 * | 9/2009 | Trangsrud | 220/4.03 |
| 7,779,587 | B1 * | 8/2010 | Meyer | 52/263 |
| D636,099 | S * | 4/2011 | Curtin et al. | D25/156 |
| 2004/0231808 | A1 * | 11/2004 | Belanger | 160/199 |
| 2007/0056229 | A1 * | 3/2007 | Lu | 52/198 |
| 2008/0188175 | A1 * | 8/2008 | Wilkins | 454/347 |
| 2013/0200636 | A1 * | 8/2013 | Hagemeyer et al. | 292/202 |

* cited by examiner

GRILLE DOOR OPENER

FIELD OF THE INVENTION

The present invention relates to a door opener for a linear bar grille.

BACKGROUND OF THE INVENTION

U.S. Patent publication 2004/0231808 relates to a folding grille assembly to be used to close an opening in a narrowing wall. The grill assembly has a pocket and a folding grille. The pocket is adapted to be mounted on one side of the opening aligned with the wall and forming part of the wall. The folding grille has a plurality of narrow, vertical, panels, the panels hingedly joined together in serial fashion by vertical hinges. Every second panel only carries a vertical mounting rod at its top end extending up from the top, center of the panel, and every second mounting rod only carries a trolley by means of which the grille can be movably supported at the top opening of the grille. The pocket forms a receptacle for the grille when the grille is folded to open the opening.

US Patent publication 2008/0188175 relates to a recirculating fan, for installation in an upper region of a building space, and having, a housing, a fan, an air vent ring defining an intake path and a discharge path, an air grille for intake and discharge paths, the air grille being releasably attached to the housing and being moveable relative to the housing, and releasable fastening devices for releasably fastening the air grille to the housing.

U.S. Pat. No. 7,566,263 relates to a combination of a grille and a connector frame for a duct outlet in an HVAC system. At least one lock element extends from one of the connector frame and the grille and releasably engages the other of the connector frame and grille in a releasable connection to hold the grille to the connector frame. The lock element may be manipulated from the exterior of the grille to release the grille from the connector frame without the use of tools.

US patent publication 2007/0056229 relates to a fastening means of an air grille including a grille face, a filtering device, a stationary frame and door latches, in which the grid face is hinged to the stationary frame with one side, and the opposite side of the grid face is fastened on the stationary frame with the door latches. The door latches molded of plastic are located on the grid face in movable connection with a catching hook at the middle portion. A pushing portion is built upon the upside of the door latch, and a L-shaped catching shoe on the lower portion. Above the L-shaped catching shoe, the catching hook is built up for holding the grid face on, and an open slot constructed of the low leg of the L-shaped shoe and the bottom of the pushing portion is used to catch on the stationary frame. When opening the grid face, just need to push the door latches respectively to outward so as to slide off from the stationary frame, then the grid face is opened wholly; in this case, locking or opening of the grid face to install or remove the filter becomes easier.

SUMMARY OF THE INVENTION

The present invention relates to a device for opening up a linear bar grille. The device comprises a recessed door lift handle. It is located between two bars of a linear bar grille access door. The access door is on an access door pivot. The recessed door lift handle comprises a pivot actuating projection. While in the closed position the recessed door lift handle only is above the bar where the pivot actuating projection is located.

The recessed door lift handle opens the access door by pushing on the pivot actuating projection and then pulling the recessed door lift handle up.

When the grille access door is lifted by the recessed door lift handle to its open position it creates an open access area.

It is an object of the present invention for the recessed door lift handle to be attached to a bar of the linear bar grille. It is an object of the present invention for a pivot pin to be attached to the bar of the linear bar grille so that the recessed door lift handle pivots from a closed to an open position and back. It is an object of the present invention for the bar to have a closed position stop pin to which the recessed door lift handle rests when it is in the closed position. It is an object of the present invention for the bar to have a pivot limit stop, to stop the door lift handle from moving any further when it is in the open position.

It is an object of the present invention for the recessed door lift handle to comprise a radiussed pivot actuating projection. It is an object of the present invention for the recessed door lift handle to comprise a precision machined counter balanced door lift end. It is an object of the present invention for the recessed door lift handle to comprise a pivot pin hole. It is an object of the present invention for the recessed door lift handle to comprise a radiussed finger grip. It is an object of the present invention for the recessed door lift handle to comprise a machined flat edge to match the profile of the linear bars on the grille.

It is an object of the present invention for the recessed door lift handle to not affect the free area of the bar grille more than 1%. It is an object of the present invention for the handle to match the aesthetics of the grille.

DETAILED DESCRIPTION OF THE INVENTION

Figure 1:
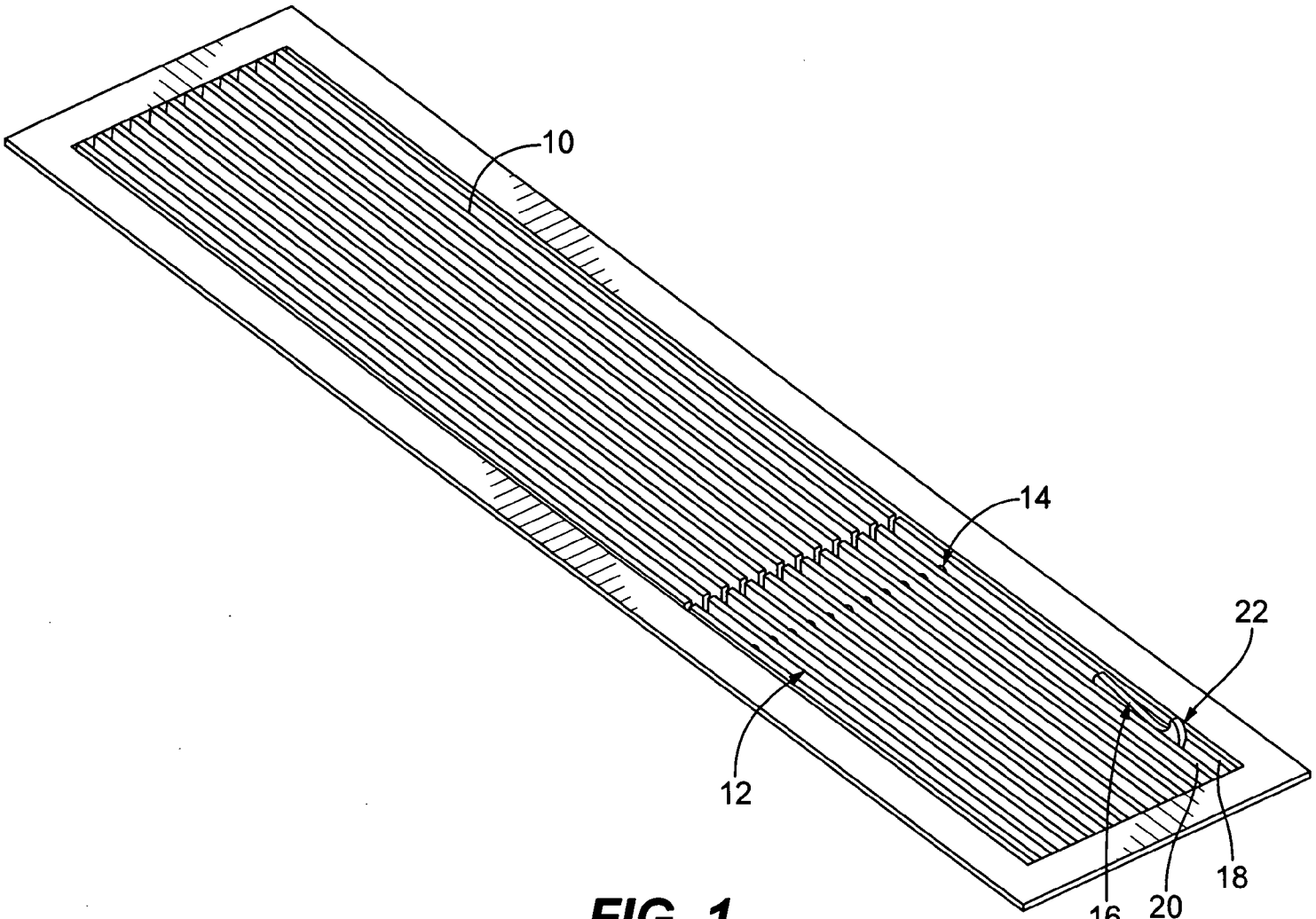
FIG. 1 is a top view of the present invention in the closed position

FIG. 1 shows the linear bar grille 10 having an access door 12. The access door 12 has an access door pivot 14. A recessed door lift handle 16 is located between two bars 18 and 20. The recessed door lift handle 16 has a pivot actuating projection 22. FIG. 1 shows the recessed door handle 16 in its closed internal position.

Figure 2:
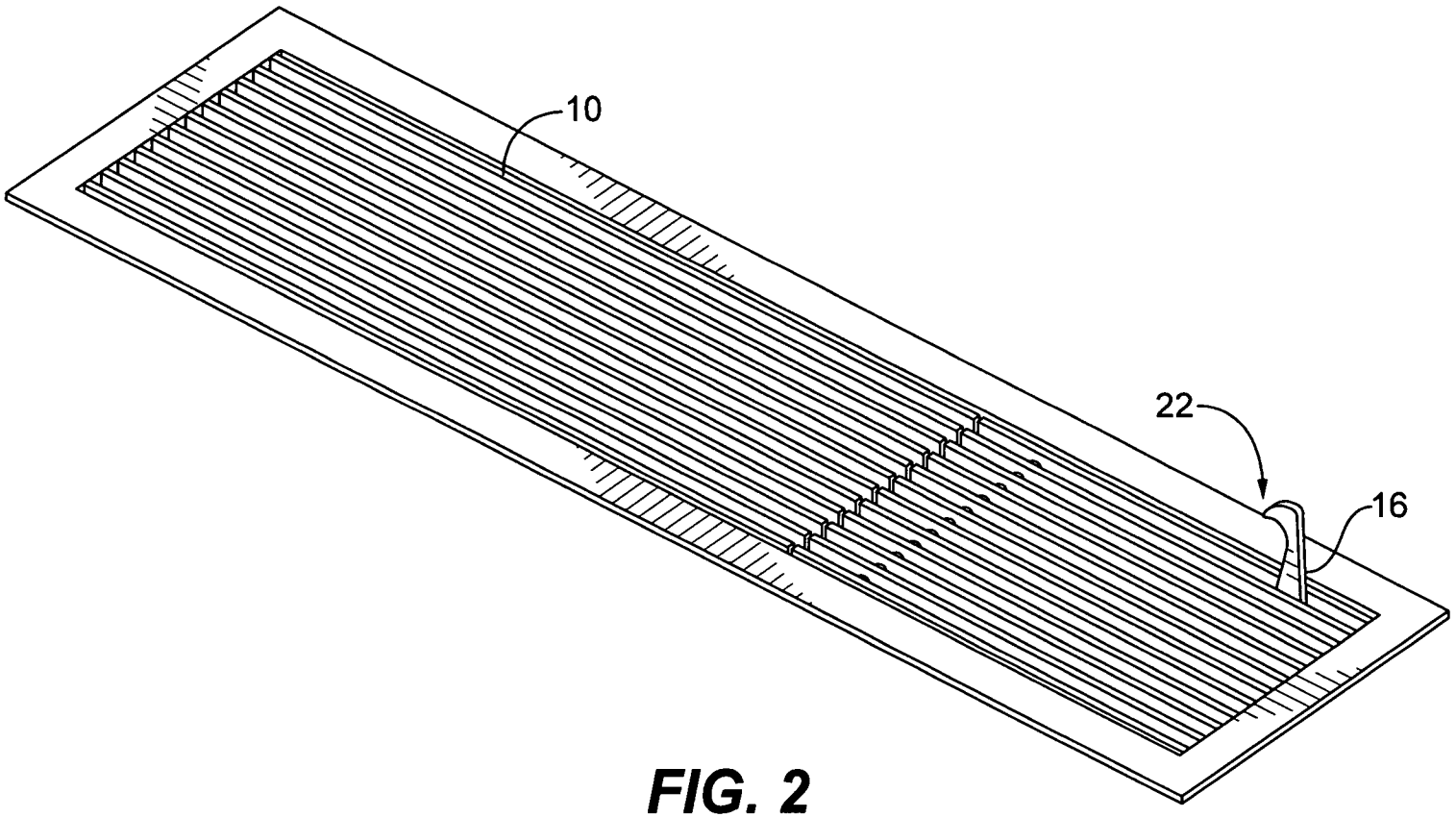
FIG. 2 is a top view of the present invention in the closed position

FIG. 2 shows the linear bar grille 10. The recessed door lift handle 16 is in its ready to lift position, having the pivot actuating projection 22 in its upward position.

Figure 3:
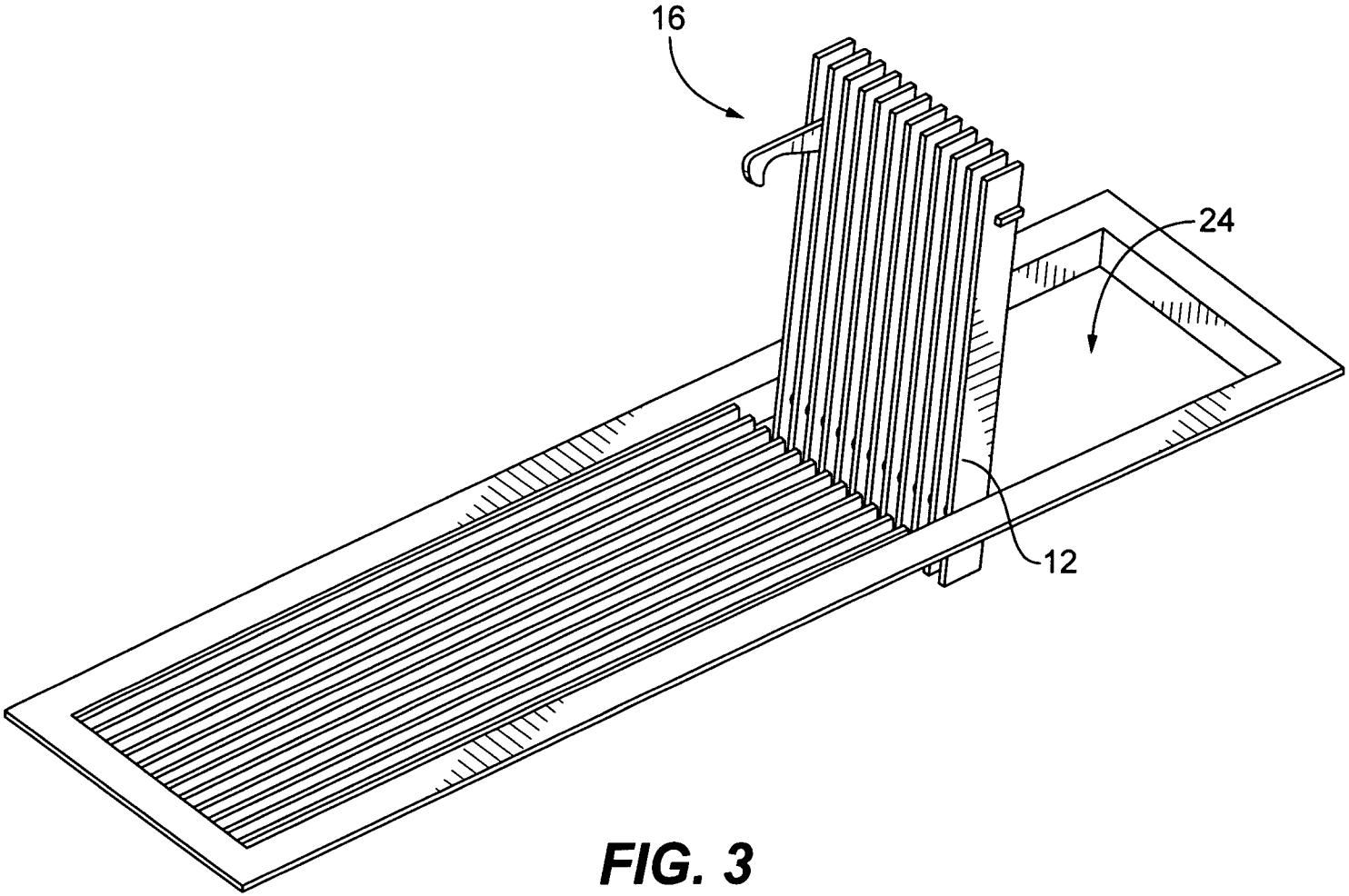
FIG. 3 is a top view of the present invention in the open position

FIG. 3 shows the grille access door 12 in its open position. The recessed door lift handle 16 has been pulled by the user to provide the grille access door 12 in its open position. When the grille access door 12 is in its open position it creates an open access area 24.

Figure 4:
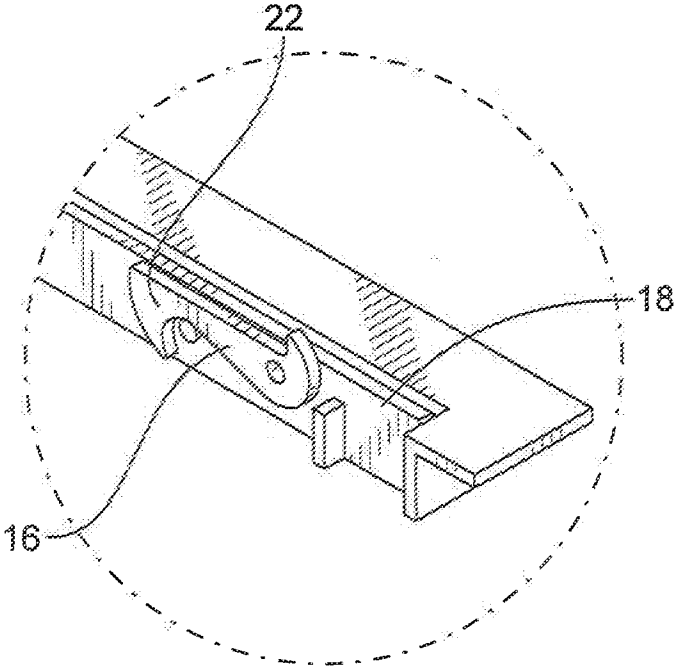
FIG. 4 is an internal view of the handle of the present invention in the closed position.

FIG. 4 shows the recessed door lift handle 16, having the pivot actuating projection 22 in its closed position. The door lift handle 16 is shown being attached to bar 18.

Figure 5:
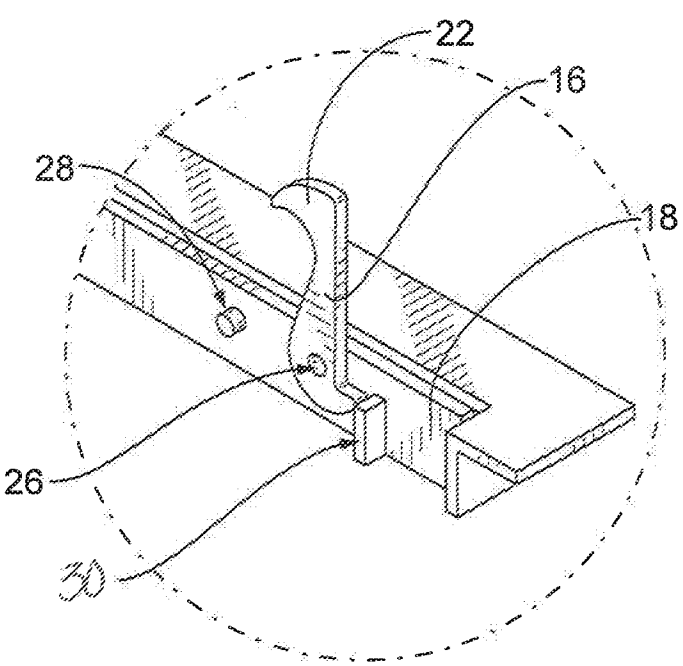
FIG. 5 is an internal view of the handle of the present invention in the open position.

FIG. 5 shows the recessed door lift handle 16, having the pivot actuating projection 22 in the ready to lift position. The bar 18 has a pivot pin attached to it from which the recessed door lift handle 16 pivots from a closed to an open position and back. The bar 18 also has a closed position stop pin to which the recessed door lift handle 16 rests when it is in the closed position. Bar 18 also has a pivot limit stop 30 to stop the door lift handle 16 from moving any further when it is in the open position.

Figure 6:
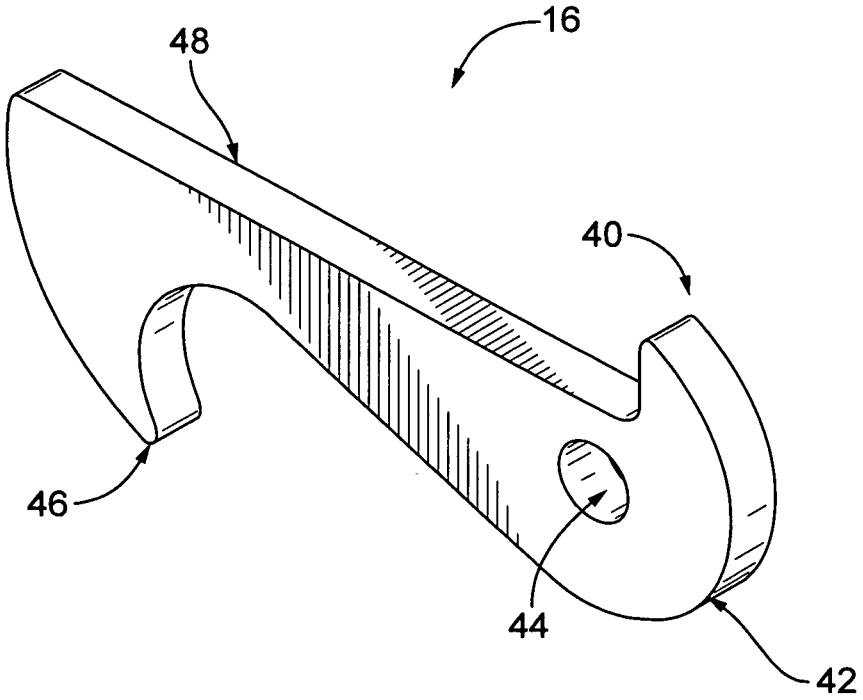
FIG. 6 is side view of the handle of the present invention.

FIG. 6 shows the recessed door lift handle 16 having a radiussed pivot actuating projection 40, a precision machined counter balanced door lift end 42, a pivot pin hole 44, a radiussed finger grip 46 and a machined flat edge 48 to match the profile of the liner bars 18 on the grille 10.

The invention claimed is:

1. A linear bar grille assembly comprising:

a linear bar grille, said bar grille comprising a plurality of bars and defining an access area;

an access door pivotally attached to said bar grille, said door comprising a further plurality of bars, said door pivoting between a closed position, preventing access to said area, and an open position, allowing access to said area;

a door lift handle located between two bars of said further plurality of bars of said door, said handle comprising a first end and an opposed end;

wherein said handle is pivoted between a rest position, having said handle maintained substantially flush between two bars of said further plurality of bars of said door, and an operating position, by pushing on said opposed end of said handle, allowing said handle to pivot so that said first end is grasped so as to pull and pivot said door to said open position.

2. The linear bar grille of claim 1 wherein when said handle is in a closed position said handle only is above said further plurality of bars where said pivot actuating projection is located.

3. The linear bar grille of claim 1 wherein when said access door is lifted by said handle to its open position it creates an open access area.

4. The linear bar grille of claim 1 wherein said handle is attached to at least one of said two bars of said door.

5. The linear bar grille of claim 1 further comprising a pivot pin is attached to at least one of said two bars of said door so that said handle pivots from a closed to an open position and back.

6. The linear bar grille of claim 1 further comprising a closed position stop pin attached to at least one of said two bars to which said handle rests when it is in said closed position.

7. The linear bar grille of claim 1 further comprising a pivot limit stop attached to at least one of said two bars to stop said handle from moving any further when it is in said open position.

8. The linear bar grille of claim 1 wherein said handle comprises a radiussed pivot actuating projection.

9. The linear bar grille of claim 1 wherein said handle comprises a precision machined counter balanced door lift end.

10. The linear bar grille of claim 1 wherein said recessed door lift handle comprises a pivot pin hole.

11. The linear bar grille of claim 1 wherein said handle comprises a radiussed finger grip.

12. The linear bar grille of claim 1 wherein said handle comprises a machined flat edge to match profile of said linear bars on said bar grille.

13. The linear bar grille of claim 1 wherein said handle does not affect free area of said bar grille more than 1%.

* * * * *